US009371618B2

(12) United States Patent
Killion et al.

(10) Patent No.: US 9,371,618 B2
(45) Date of Patent: Jun. 21, 2016

(54) COLD PLANER SPRAY SYSTEM AND METHOD

(71) Applicant: Caterpillar Paving Products Inc., Brooklyn Park, MN (US)

(72) Inventors: Daniel H. Killion, Blaine, MN (US); Eric S. Engelmann, Delano, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 128 days.

(21) Appl. No.: 14/468,070

(22) Filed: Aug. 25, 2014

(65) Prior Publication Data

US 2016/0053446 A1 Feb. 25, 2016

(51) Int. Cl.

| | |
|---|---|
| ***G06F 7/70*** | (2006.01) |
| ***E01C 23/088*** | (2006.01) |
| ***E01C 23/12*** | (2006.01) |

(52) U.S. Cl.

CPC ..... *E01C 23/088* (2013.01); *E01C 23/127* (2013.01)

(58) Field of Classification Search

None

See application file for complete search history.

(56) References Cited

U.S. PATENT DOCUMENTS

| | | | | |
|---|---|---|---|---|
| 4,325,580 | A | 4/1982 | Swisher, Jr. et al. | |
| 8,147,164 | B2 | 4/2012 | Will et al. | |
| 8,668,274 | B2 | 3/2014 | Gaertner et al. | |
| 2004/0036346 | A1 | 2/2004 | Johannes Klaasse | |
| 2004/0211092 | A1 | 10/2004 | Barnes | |
| 2009/0052987 | A1 | 2/2009 | Hall et al. | |
| 2010/0085185 | A1* | 4/2010 | Nielsen | G01V 3/15 340/540 |
| 2011/0293368 | A1 | 12/2011 | Erdmann et al. | |
| 2014/0061329 | A1* | 3/2014 | Ngo | B05B 9/06 239/11 |
| 2014/0191560 | A1 | 7/2014 | Gaertner et al. | |

FOREIGN PATENT DOCUMENTS

| | | | |
|---|---|---|---|
| CN | 202157264 | U | 3/2012 |
| CN | 202247649 | U | 5/2012 |
| CN | 103696350 | A | 4/2014 |
| WO | WO 02/095144 | A1 | 11/2002 |

OTHER PUBLICATIONS

Atlas Copco, "Dynapac Compact Planers: Dynapac PL350, PL500 and PL1000," product brochure, 12 pp.

* cited by examiner

*Primary Examiner* — Adam Alharbi

(74) *Attorney, Agent, or Firm* — Leydig, Voit & Mayer, Ltd.

(57) ABSTRACT

A system and method for operating a cold planer includes a method for operating a cold planer. In a method, a signal indicative of an operating state is used to determine an operating condition, which is a basis for deciding which spray banks from a plurality of spray banks should be activated. Thereafter, a water flow required to operate the spray banks is estimated and a pump command signal is determined. The pump is operated and a water pressure in a main manifold is monitored such that the pump is controlled using a closed-loop control scheme that receives the water pressure as feedback to maintain a desired water pressure within the main manifold.

20 Claims, 6 Drawing Sheets

COLD PLANER SPRAY SYSTEM AND METHOD

TECHNICAL FIELD

This patent disclosure relates generally to machines and, more particularly, to a water spray system for a cold planer machine.

BACKGROUND

When resurfacing an asphalt road surface, at least a portion of the upper surface of the roadway is milled by specialized equipment so a new layer of asphalt can be deposited. The milling operation, which can also be referred to as cold planing, asphalt milling, or profiling, can be carried out at any desired depth depending on the resurfacing operation. Typically, a road surface is milled, and the material removed from the road is collected for recycling. Material suitable for recycling is ground and used as aggregate in new pavement. Milling operations in general are also used to control heights and clearances of other road structures such as curb reveals, manhole and catch basin heights, shoulder and guardrail heights, overhead clearances and the like in both finished and unfinished road surfaces.

Milling is generally performed by construction equipment called milling machines or cold planers. These machines typically use a large rotating drum for removing and grinding the road surface. The drum is usually enclosed in a housing that shields the surroundings from flying debris and contains the milled material, which is collected and deposited on a conveyor for loading onto a waiting truck. Many cold planers use an up-cut configuration, in which the drum rotates in the reverse direction to the drive wheel or tracks, which helps drive the milled material up and into a conveyor. This configuration also creates considerable amounts of dust and other airborne debris, which can be controlled by various methods including water spraying and using vacuum collectors. The water sprayed operates to cool the cutting drum and also help contain or settle dust. A typical cold planer will carry a water reservoir onboard that feeds the water sprays. However, cold planers may operate in remote areas where water is not readily accessible and must be delivered by truck. Water replenishment also requires the machine to stop operation and thus increase the time required to complete a project.

SUMMARY OF THE DISCLOSURE

In one aspect, the disclosure describes a cold planer. The cold planer includes a frame and a drum enclosed within a housing and arranged to rotate about a drum axis. The drum is connected to the frame and configured to plane a road surface during operation. The cold planer further includes a primary rotor chamber spray bank mounted to the frame and disposed in the housing, the primary rotor chamber spray bank including a first plurality of spray nozzles arranged along a first spray manifold, the first plurality of spray nozzles being arranged parallel to the drum axis and being oriented such that a plurality of water sprays provided therethrough are directed towards the drum. A water reservoir is mounted on the frame and configured to enclose and contain water, and a pump is fluidly associated with the water reservoir and configured to draw the water therefrom, pressurize the water, and provide pressurized water to a main spray manifold connected to the frame. The pump is configured to pressurize the water to a variable pressure in response to a pump signal. A pressure sensor is associated with the main spray manifold and configured to provide a pressure signal indicative of a pressure of the pressurized water within the main spray manifold.

In one embodiment, a first control valve is fluidly disposed between the main spray manifold and the first spray manifold. The first control valve selectively fluidly connects the main with the first spray manifolds in response to a valve signal. An electronic controller is associated with the cold planer and configured to receive a plurality of operating signals indicative of an operating condition of the cold planer. The electronic controller is disposed to monitor the plurality of operating signals, determine an operating state of the cold planer based on the operating signals, and determine whether the primary rotor spray bank should be activated based on the operating state. The controller is further configured to estimate an amount of pressurized water that will be required to operate the primary rotor spray bank, when it is determined that the primary rotor spray bank should be activated, determine a desired main spray manifold pressure based on the estimated amount of pressurized water, determine the pump signal based on the desired main spray pressure, send the pump signal to the pump, activate the first control valve by sending the valve signal to the first control valve when it is determined that the primary rotor spray bank should be activated, and maintain the desired main spray manifold pressure by adjusting the pump signal based on the pressure signal as a primary control parameter continuously during operation.

In another aspect, the disclosure describes a machine that includes a frame and a drum enclosed within a housing and arranged to rotate about a drum axis. The drum is connected to the frame and configured to plane a road surface during operation. The machine further includes a first spray bank mounted to the frame, where the first spray bank includes a first plurality of spray nozzles arranged along a first spray manifold, and where the first plurality of spray nozzles being oriented to wet the drum. A water reservoir is mounted on the frame, and a pump is fluidly associated with the water reservoir and configured to draw water therefrom. The pump is configured to pressurize the water to a variable pressure in response to a pump signal, pressurize the water, and provide pressurized water to a main spray manifold. A pressure sensor is associated with the main spray manifold and configured to provide a pressure signal indicative of a pressure of the pressurized water within the main spray manifold. A first control valve is fluidly disposed between the main spray manifold and the first spray manifold, the first control valve selectively fluidly connecting the main with the first spray manifolds in response to a valve signal.

An electronic controller is associated with the cold planer and configured to receive a plurality of operating signals indicative of an operating condition of the cold planer. The electronic controller is disposed to monitor the plurality of operating signals and determine an operating state of the cold planer based on the operating signals. The controller further determines whether the first spray bank should be activated based on the operating state, and estimates an amount of pressurized water that will be required to operate the first spray bank when it is determined that the first spray bank should be activated. The controller then determines a desired main spray manifold pressure based on the estimated amount of pressurized water, determines the pump signal based on the desired main spray pressure, and sends the pump signal to the pump. The first control valve is activated by sending the valve signal to the first control valve when it is determined that the first spray bank should be activated. During operation, the controller maintains the desired main spray manifold pressure by adjusting the pump signal based on the pressure signal as a primary control parameter.

In yet another aspect, the disclosure describes a method for operating a cold planer. The method includes generating at least one signal indicative of an operating state of the cold planer and determining, based on the at least one signal, an operating condition of the cold planer using an electronic controller. The method further includes deciding which spray banks from a plurality of spray banks should be activated based on the operating condition determination using the electronic controller, estimating a water flow required to operate the spray banks that should be activated, and determining a pump command signal for a water pump that provides the water flow using the controller. In accordance with the method, the pump is commanded to operate by sending the pump command signal from the controller to a pump-related actuator, and a water pressure in a main manifold is monitored such that the pump is controlled using a closed-loop control scheme that receives the water pressure as feedback to maintain a desired water pressure within the main manifold.

DETAILED DESCRIPTION

The present disclosure relates to fluid controls for machines and, more specifically, to a water spray system for a cold planer. Although the present embodiments are described in the context of a water spray system for a cold planer, it should be appreciated that the spray systems and methods described are applicable to other machines and applications in which use of a secondary or working fluid, such as water, is conserved by accurate and automated control that depends on the particular operation performed by the respective machine.

Figure 1:
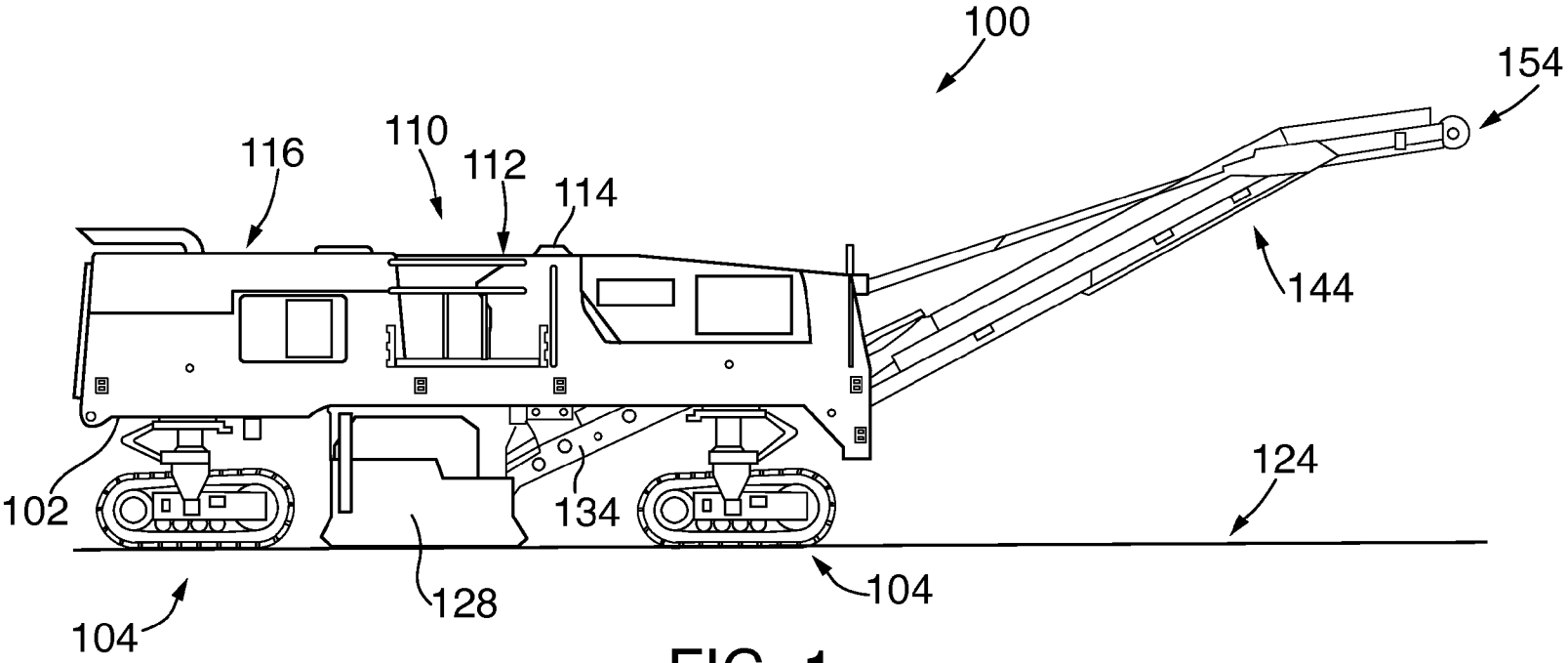
FIG. 1 is an outline view of a machine in accordance with the disclosure.
Figure 2:
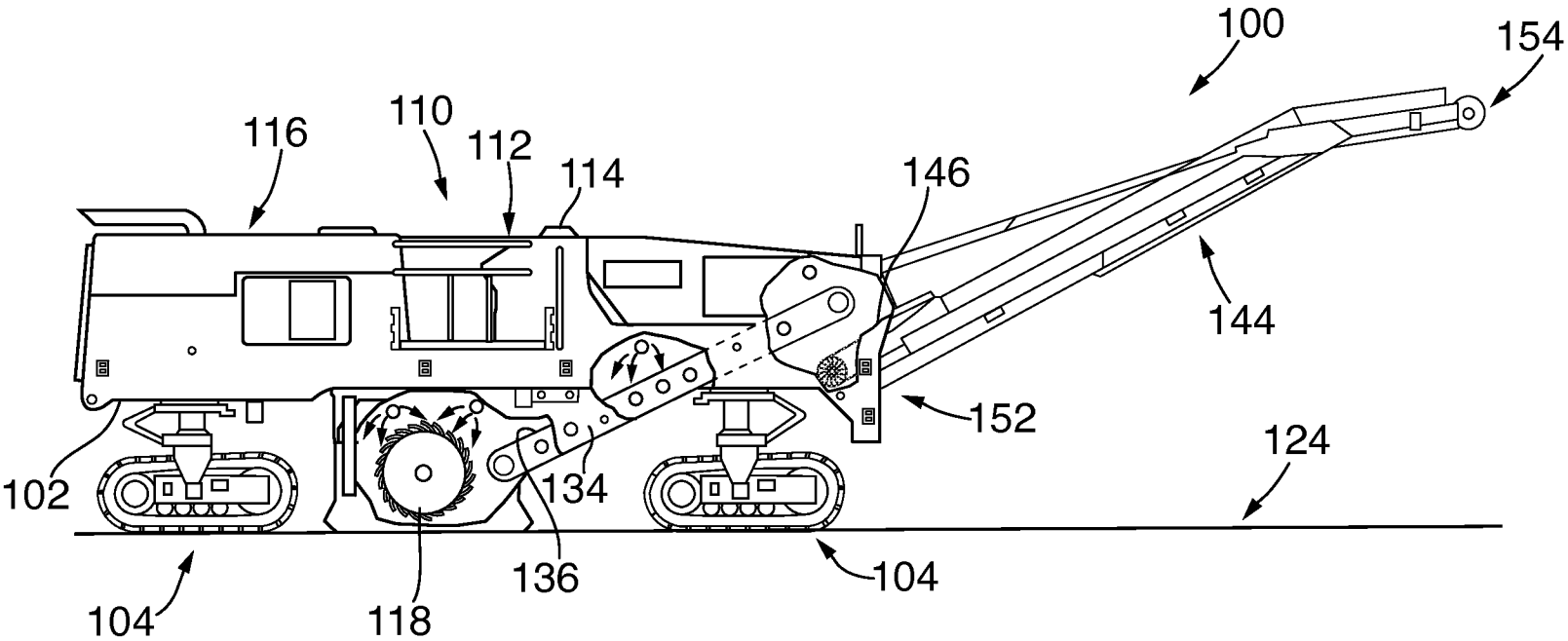
FIG. 2 is a partially fragmented view of the machine of shown in FIG. 1.
Figure 3:
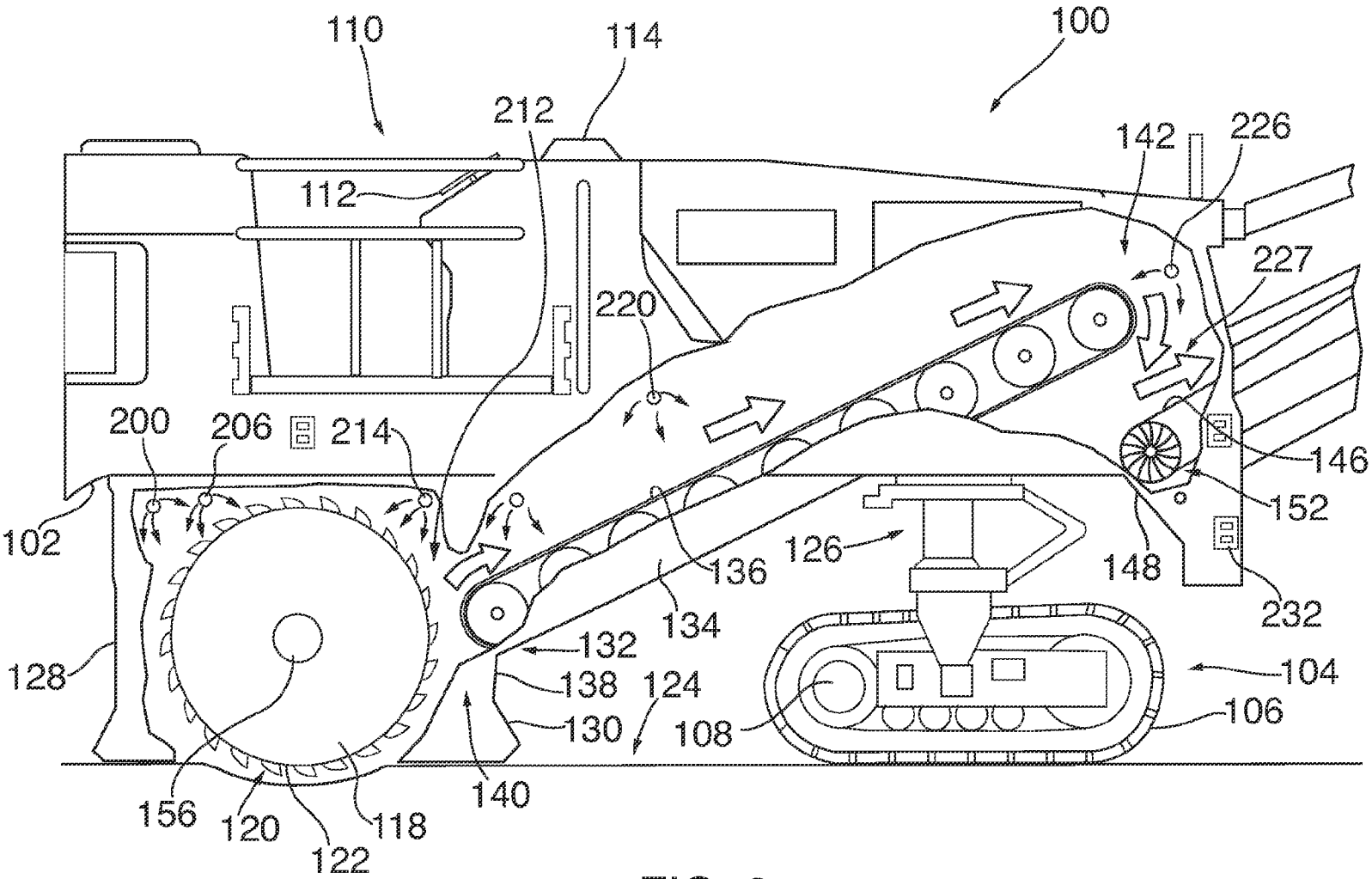
FIG. 3 is an enlarged detail view of FIG. 2.

Referring now to the drawings, in which like reference numerals represent like parts throughout the several views, FIG. 1 shows a cold planer 100 in accordance with an embodiment. FIGS. 2 and 3 show fragmented, detailed views of certain operating portions of the cold planer 100. The cold planer 100 is generally of typical construction and includes a frame 102 supported by four (two visible) ground engaging members 104, the orientation and height of which relative to the frame 102 are selectively adjustable. Each ground engaging member 104 includes a track 106 (FIG. 3) that is powered in two directions by a hydraulic motor 108. Operation of the cold planer 100 can be carried out remotely by an operator, or locally from an operator portion 110. From the operator portion 110, an operator may manipulate various machine control devices such as one or more steering devices 112, a control panel 114 that includes various control switches, and the like. The frame 102 further supports an engine (not shown) enclosed within an engine enclosure 116 and connected to various mechanical, hydraulic and/or electric systems operating the various portions of the cold planer 100.

For milling a road surface or any other surface, the cold planer 100 includes a milling drum 118 that is rotatably supported on the frame 102 and configured for powered rotation relative thereto during operation. The drum 118 has a generally cylindrical shape and includes a plurality of cutting elements or teeth 120 that are disposed along a peripherally outer portion 122 thereof and contact the ground, and perform cuts as the drum 118 rotates and the cold planer 100 advances along a surface 124 to be milled. In the illustrated embodiment, for example, as shown in FIG. 3, the drum 118 rotates in the direction of the arrow in a counter-clockwise direction as the machine moves in a forward direction towards the right side of the figure. A cutting depth of the drum 118 can be determined by a height-adjustment mechanism disposed between the drum 118 and the frame 102, but in the illustrated embodiment is controlled by controlling the height of the frame 102 with respect to the surface 124 by appropriately extending and retracting vertical actuators 126 (FIG. 3) disposed between the ground engaging members 104 and the frame 102.

The rotating drum 118 is enclosed within a shield or housing 128 that includes four walls surrounding the drum 118 around its sides, front and rear, and extend between the frame 102 and the ground or working surface 124. A front wall 130 of the housing 128 includes an opening 132, through which an intermediate stage conveyor 134 extends. The intermediate stage or first conveyor 134 is embodied in the illustrations as an endless-type conveyor that includes a conveyor belt 136 that continuously circulates around rollers 138, at least one of which is powered. The intermediate stage conveyor 134 has an input side 140, which is disposed close to the drum 118, and an output side 142, which is disposed further in the forward direction and higher relative to the frame 102 than the input side 140.

During operation, debris milled from the surface 124 by the rotating drum 118 is flung or otherwise directed towards the input side 140 of the intermediate conveyor 134 such that material removed from the surface 124 can be deposited on the belt 136. Arrows in FIG. 3 denote the material transfer path. A final stage conveyor 144 is disposed adjacent the output side 142 of the intermediate stage conveyor 134 and is configured to receive material for delivery to a location off the cold planer 100, for example, into a leading truck (not shown), in the customary fashion. More specifically, the final stage conveyor 144 is arranged as an endless conveyor that includes a belt 146 circulating around rollers 148, at least one of which is powered. The final stage conveyor 144 includes a frame 150 that is pivotally connected at one end 152 to the frame 102 such that it can rotate and pivot relative to the frame 102 during operation. The one end 152, which is also an input side of the final stage conveyor 144, is disposed beneath the output side 142 of the intermediate stage conveyor 134 to receive material therefrom, which is then dropped off an output side 154 of the final state conveyor 144 into a waiting truck bed (not shown).

Figure 4:
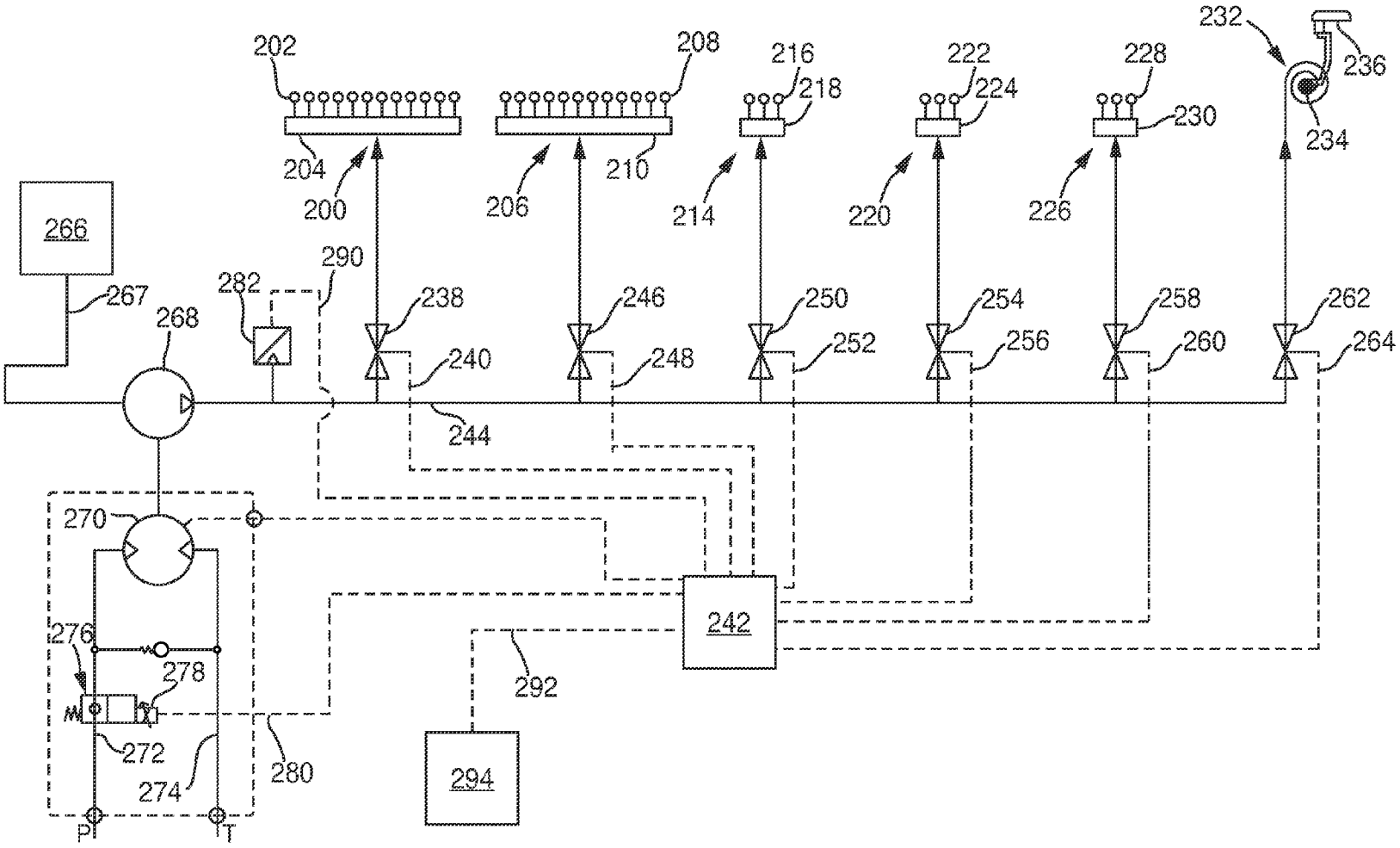
FIG. 4 is a schematic view of a spray system in accordance with the disclosure.

To control dust and airborne debris during operation, and to also lubricate and cool the drum 118, the cold planer 100 includes various sprays disposed to deliver a water spray of a predetermined pattern and flow rate to various operating portions of the machine. In the illustrated embodiment, six different water spray banks are shown disposed at various locations on the cold planer, but fewer or more than six can be used. More specifically, the cold planer 100 includes a primary or first rotor chamber spray bank 200, which includes a plurality of spray nozzles 202 arranged in parallel along a spray manifold 204, as shown in FIG. 4. In reference to FIG. 3, the spray nozzles 202 and manifold 204 are mounted on the frame 102 in a rearward position relative to a rotation axis 156 of the drum 118, arranged along the width of the cold planer 100 parallel to the rotation axis 156, and are oriented such that various water sprays are directed towards the drum 118 to wet the drum 118. Water provided to the drum 118 through the rotor chamber spray bank 200 acts to cool the cutting elements of the drum from heat generated during the milling operation, and lubricates those cutting elements.

The cold planer 100 further includes an additional or second rotor chamber spray bank 206, which includes a second plurality of spray nozzles 208 arranged in parallel along a second spray manifold 210, as shown in FIG. 4. In further reference to FIG. 3, the second plurality of spray nozzles 208 and manifold 210 are mounted on the frame 102 in a rearward position and parallel to the first plurality of spray nozzles 202, and are oriented such that various water sprays are directed towards the drum 118 to augment the water delivery capability of the machine, as required during operation. For example, when milling a shallow depth, at a high drum speed, additional heat generated by the milling operation may require additional water for cooling and lubrication of the cutting tools.

The cold planer 100 further includes a transition spray bank 214 that generates water sprays directed towards a drum transition region 212 between the drum 118 and the input side 140 of the intermediate stage conveyor 134, through which material is flung from the drum 118 onto the conveyor belt 136. During operation, water provided to the drum 118 through the second rotor chamber spray bank 206 acts to further cool and lubricate the cutting elements of the drum, as well as suppress dust and other airborne particles that may be generated in the transition region 212. The transition spray bank 214 includes a third plurality of spray nozzles 216 that are connected to a third spray manifold 218.

The cold planer 100 additionally includes an intermediate stage conveyor spray bank 220 that generates water sprays directed towards the material travelling on the belt 136 of the intermediate stage conveyor 134. During operation, operation of this spray bank may be optional and used for material that is either generating more dust that what can be effectively suppressed by the spray banks upstream in the material flow direction, and/or material that has been heated by the milling operation and requires additional cooling to quench the material and reduce the formation of vapors. The intermediate stage conveyor spray bank 220 includes a fourth plurality of spray nozzles 222 that are connected to a fourth spray manifold 224.

The cold planer 100 also includes a final stage conveyor spray bank 226 that generates water sprays directed towards the material travelling on the belt 146 of the final stage conveyor 144. During operation, operation of this spray bank may be optional and used for material that is either generating more dust that what can be effectively suppressed by the spray banks upstream in the material flow direction, and/or material that may still retain heat from the milling operation. The final stage conveyor spray bank 226 includes a fifth plurality of spray nozzles 228 that are connected to a fifth spray manifold 230.

For providing the user and other personnel working alongside the cold planer 100 a water source, for example, for rinsing machine components during or after a milling operation, the cold planer 100 further includes a low pressure spray bank 232 that includes one or more reeled hoses 234 connected to a manual spray nozzle 236. During operation, when the low pressure spray bank 232 is active, a worker may dispense a desired length of hose 234 and deliver a low pressure water spray from the manual nozzle 236 as desired.

The water flow and water pressure provided to each of the six spray banks described above is controlled by a respective electro-mechanical flow control valve. Specifically, a first valve 238, which is responsive to a first control signal provided by a first line 240 to the first valve 238 from an electronic controller 242, selectively fluidly interconnects the first spray manifold 204 with a main distribution manifold 244 in response to the first control signal. Similarly, a second valve 246 communicates with the controller 242 via a second line 248 providing a second control signal for fluidly connecting the second manifold 210 with the main distribution manifold 244; a third valve 250 communicates with the controller 242 via a third line 252 providing a third control signal for fluidly connecting the third manifold 218 with the main distribution manifold 244; a fourth valve 254 communicates with the controller 242 via a fourth line 256 providing a fourth control signal for fluidly connecting the fourth manifold 224 with the main distribution manifold 244; a fifth valve 258 communicates with the controller 242 via a fifth line 260 providing a fifth control signal for fluidly connecting the fifth manifold 230 with the main distribution manifold 244; and a sixth valve 262 communicates with the controller 242 via a sixth line 264 providing a sixth control signal for fluidly connecting the one or more hoses 234 with the main distribution manifold 244.

Water under pressure is present in the main distribution manifold 244 during operation. The water is drawn from a reservoir 266 by a pump 268 through a supply pipe 267. The pump 268 is embodied as a variable-speed pump, which can control the flow and/or pressure of water provided to the main distribution manifold. Although the pump 268 is a variable-speed pump in the embodiment shown in FIG. 4, other pump types may be used, including variable-displacement and positive-displacement pumps may be used to control the flow and/or pressure of water provided to the main distribution manifold 244. In the illustrated embodiment, the pump 268 is driven by a variable-speed hydraulic motor 270 that can operate in both directions to supply and draw water from the main distribution manifold 244. The hydraulic motor 270 is supplied by pressurized hydraulic fluid via first and second conduits 272 and 274 through a control valve 276. The control valve 276 is a two-port, infinite-position flow control valve operated by an electrical actuator 278 that is responsive to a pump control signal provided via a pump control line 280 from the controller 242.

For controlling the pump 268, a water pressure sensor 282 is associated with the main distribution manifold 244 and arranged to provide a signal indicative of a real-time water pressure therewithin. The water pressure sensor 282 provides a pressure signal via a pressure signal line 290 to the controller 242. The controller 242 further receives information on the operating mode of the cold planer 100 via an interface 292 that is connected to various other machine components and systems, which are collectively denoted by reference numeral 294 in FIG. 4. The various other machine components and can include signals from various switches, levers, engine controls, and other machine controls that are indicative of a machine operating condition. Representative machine operating conditions can include information on whether the machine is milling or travelling, a depth and speed of planing, the type of material being milled, a power draw of the drum, whether the intermediate stage and/or final stage conveyors are operating, the operating speed of the conveyor(s), the operating speed of the drum, the type of drum used, whether a vacuum for dust control is present and, if so, whether the vacuum is operational, and other parameters.

The controller 242, based on the signals provided from the interface 292, can determine which spray banks shall operate, and provide appropriate command signals to the respective valves, as previously described. Moreover, based on an estimated water flow through the main distribution manifold 244, which depends on the water flow provided to any of the spray banks that are activated, the controller may further provide an appropriate pump control signal that will cause the pump 268 to operate and provide a water flow that is equal to, or just above, the estimated water flow. Such pump control can be carried out in a closed loop fashion, automatically by the controller based on the pressure signal from the pressure sensor 282 as feedback, for example, in a proportional, integral, and derivative term (PID) controller using a pressure in the manifold as a setpoint. Alternatively, in one embodiment, the machine may operate in a manual mode, in which the operator may manually set a pressure setpoint for the spray manifold. Thereafter, during operation, the system may work in much the same way as in the automatic mode of operation whereby the pump is controlled to maintain the setpoint pressure automatically and regardless of the spray banks that are manually activated by the operator. In both these embodiments, efficiency in water usage, and reduction of parasitic power usage at the pump 268, can be advantageously improved.

Figure 5:
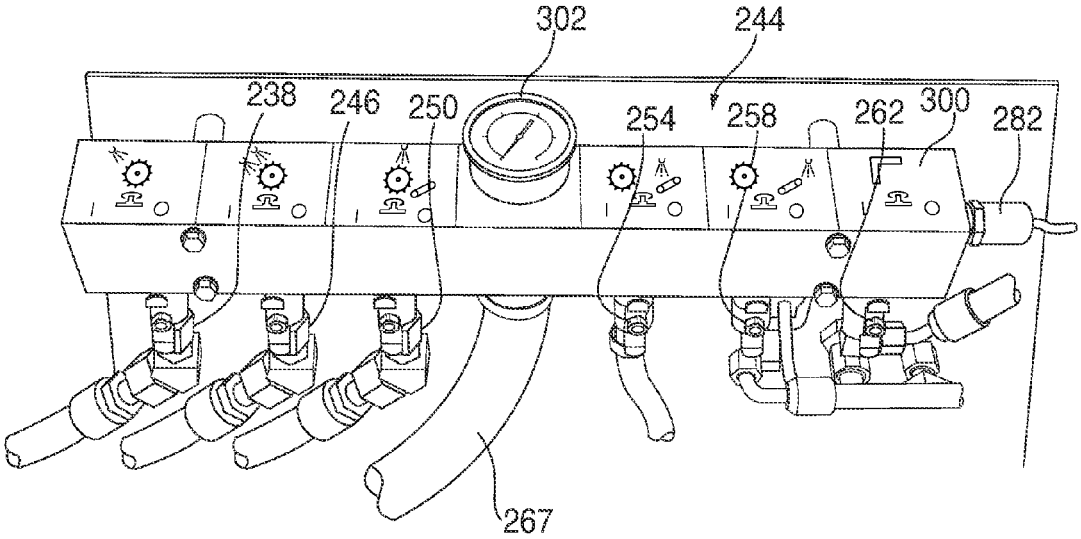
FIG. 5 is a perspective view of a spray control manifold in accordance with the disclosure.

One embodiment for the main distribution manifold 244 is shown in FIG. 5, in which like structures and elements are denoted by the same reference numerals as previously used for simplicity. As shown, the main distribution manifold 244 includes a housing 300, which is mountable to the machine frame and which can be manufactured as a steel casting. The housing 300 forms various ports into which the first valve 238, second valve 246, third valve 250, fourth valve 254, fifth valve 258 and sixth valve 262 can be directly installed. Each of these valves can be further connected to a respective pressure-hose that provides the corresponding water flow to the respective spray nozzles in the machine. A manometer 302 connected to the housing 300 and configured to sense a water pressure therein may provide a quick visual indication of water pressure to the operator when the housing 300 is mounted in a visible location on the machine. The pressure sensor 282 may also be connected directly to the housing 300. The housing 300 may further illustrate graphically the spray bank controlled by each valve, and switches may be mounted adjacent to these graphics to manually control each spray bank for activation by the operator.

INDUSTRIAL APPLICABILITY

The control systems and methods described herein and shown in the various figures, for example, in FIG. 4, can be advantageously used in a cold planer, for example, the cold planer 100 shown in FIG. 1. By using electronically controlled valves to control the water flow provided to each spray bank, each water spray bank can be turned on and off remotely by the operator and/or by the machine controller when certain operating conditions are met. These remote controls can be placed for convenient operation by the operator, for example, in the display, control panel switches/buttons, and the like, for access during machine operation. In one embodiment, the water spray banks can be turned on and off automatically based on machine operating conditions, for example, based on sensor readings, status of machine functions such as rotor drive, conveyor, vacuum dust control, and the like. In a more basic implementation, the remote control of the valves can allow the operator to simply open and close the desired valve(s) during machine operation based on the specific needs of the application, as determined in real time by the operator. Use of proportional valves for the individual water banks allows for precise, repeatable flow limiting into each bank. This enables automatic flow limiting based on machine operating conditions or manual remote flow limiting by the operator, for example, by setting a desired flow and/or a manually input water pressure setpoint in an operator interface or display. Alternatively, on/off valves can be used to simplify the system and reduce cost, but with some loss of the above-stated functionality.

Figure 6:
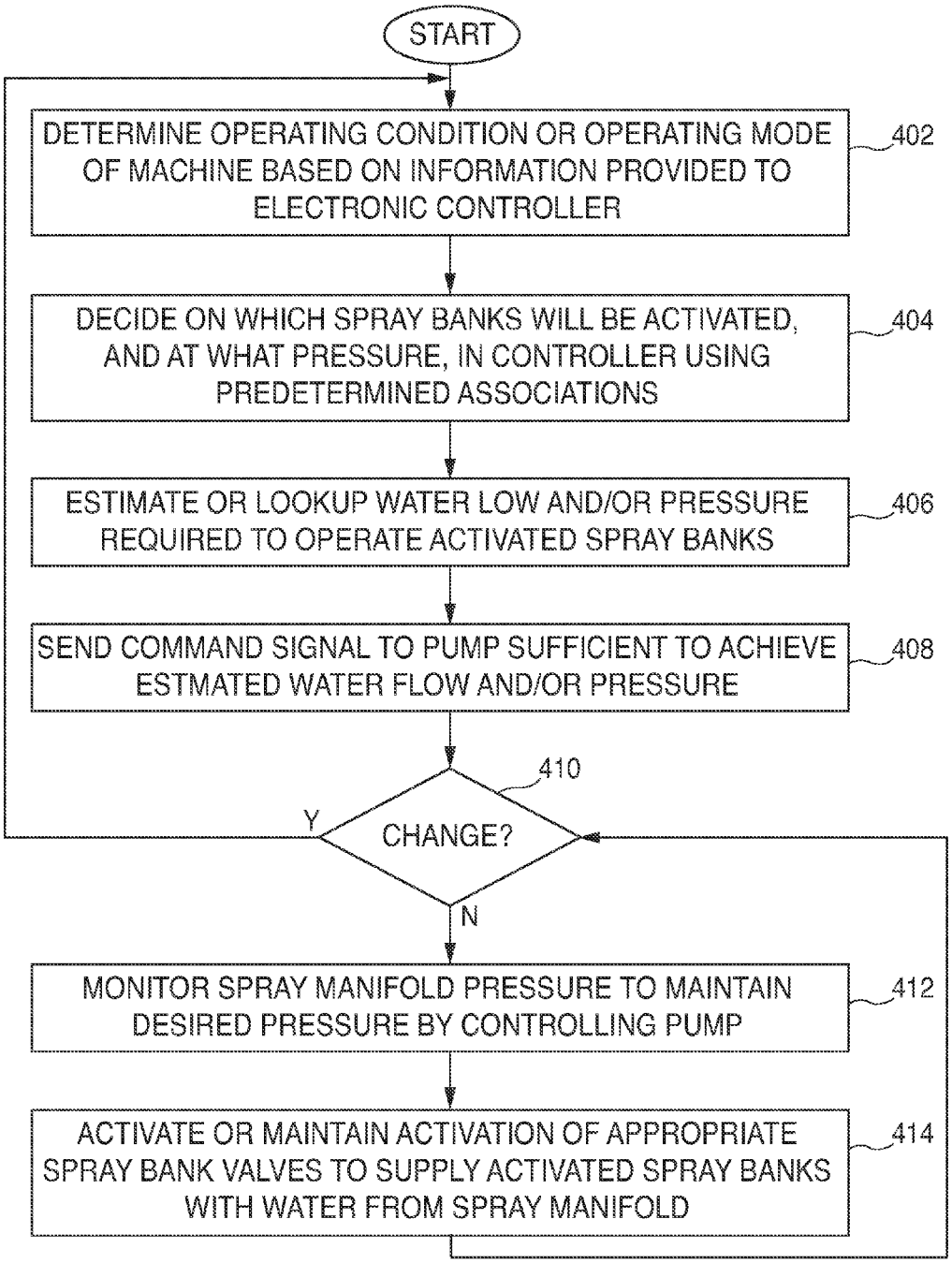
FIG. 6 is a flowchart for a method of controlling a water system on a cold planer in accordance with the disclosure.

A method for operating a water system on a cold planer is illustrated in the flowchart of FIG. 6. The recited method can be carried out by any appropriate means such as by a computer-executable algorithm operating within a programmable controller, for example, the controller 242 (FIG. 4). At the beginning of the process, the control system may determine an operating condition and/or operating mode of the machine at step 402. This determination may be carried out automatically, for example, by supplying information indicative of the operating state of the machine into a selection routine of the algorithm. Information indicative of the operating state of the machine may include information indicative of drum operation and speed, conveyor belt activation and speed, machine ground speed, vacuum system activation, type of material planed, planing depth, and other information. All such information may be input to a multi-dimensional lookup function or table that correlates, based on predetermined relationships, the various operating mode signals with activation and/or pressure of activation of the various spray banks on the machine. Based on the operating information, the control determined or decides which spray banks will be activated, and at what pressure, using the lookup function at step 404. For instance, a signal indicating that the cutting drum is operating may call for automatic activation of the first rotor chamber spray bank 200. A signal indicating that a dust vacuum system, which is configured to draw dust particles from the atmosphere within the housing in which the drum is operating, is not activated while the drum is operating may call for automatic activation of the second rotor chamber spray bank 206 while the first rotor chamber spray bank 200 is also active. Similarly, the various other spray banks may be activated when the intermediate and final stage conveyors are operating.

After the various spray banks, and their operating pressures, have been determined, the system will estimate the aggregate water flow and pressure that should be provided to the main spray manifold at step 406. Alternatively, this determination can be made based on an operator input of a desired pressure. The estimation may involve a flow calculation, or may alternatively be a determination based on pre-existing flows for the individual spray banks, which are added to produce the aggregate amount based on which spray banks are active. Once the desired water flow and/or pressure has been determined, a command signal is provided to the pump at step 408. The command signal is sufficient to achieve the estimated water flow and/or pressure within the spray distribution manifold.

An interrogation of whether a change has occurred in the desired water flow is made at 410. When a new operating condition is present, which may also include a manual spray bank activation by the operator, the controller recalculates the pump command beginning from step 402. If no changes are present at 410, the process continues with monitoring manifold pressure at 412, and controlling the pump to maintain that pressure, for example, using a closed loop control scheme that has manifold pressure as a feedback. When the pressure has stabilized, or even before it has stabilized, the appropriate control valves are opened in response to appropriate control signals at step 414, and water is delivered to the various portions of the machine. This water spray continues and the manifold is maintained at the desired pressure while there are no command changes.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A cold planer machine comprising a frame and a drum enclosed within a housing and arranged to rotate about a drum axis, the drum connected to the frame and configured to plane a road surface during operation, the cold planer comprising:

a primary rotor spray bank mounted to the frame and disposed in the housing, the primary rotor chamber spray bank including a first plurality of spray nozzles arranged along a first spray manifold, the first plurality of spray nozzles being arranged parallel to the drum axis and being oriented such that a plurality of water sprays provided therethrough are directed towards the drum;

a water reservoir mounted on the frame and configured to enclose water;

a pump fluidly associated with the water reservoir and configured to draw the water therefrom, pressurize the water, and provide pressurized water to a main spray manifold connected to the frame;

wherein the pump is configured to pressurize the water to a variable pressure in response to a pump signal;

a pressure sensor associated with the main spray manifold and configured to provide a pressure signal indicative of a pressure of the pressurized water within the main spray manifold;

a first control valve fluidly disposed between the main spray manifold and the first spray manifold, the first control valve selectively fluidly connecting the main with the first spray manifold in response to a valve signal;

an electronic controller associated with the cold planer and configured to receive a plurality of operating signals indicative of an operating condition of the cold planer, the electronic controller disposed to:

monitor the plurality of operating signals;

determine an operating state of the cold planer based on the operating signals;

determine whether the primary rotor spray bank should be activated based on the operating state;

estimate an amount of pressurized water that will be required to operate the primary rotor spray bank when it is determined that the primary rotor spray bank should be activated;

determine a desired main spray manifold pressure based on the estimated amount of pressurized water;

determine the pump signal based on the desired main spray pressure, and send the pump signal to the pump;

activate the first control valve by sending the valve signal to the first control valve when it is determined that the primary rotor spray bank should be activated; and maintain the desired main spray manifold pressure by adjusting the pump signal based on the pressure signal as a primary control parameter continuously during operation.

2. The cold planer of claim 1, further comprising:

a second rotor spray bank mounted to the frame and disposed in parallel with the primary rotor chamber spray bank, the second rotor chamber spray bank including a second plurality of spray nozzles arranged along a second spray manifold, the second plurality of spray nozzles being oriented such that each of a second plurality of water sprays provided therethrough is directed towards the drum;

a second control valve fluidly disposed between the main spray manifold and the second spray manifold, the second control valve selectively fluidly connecting the second spray manifold with the main spray manifold in response to a second valve signal;

wherein the electronic controller is further disposed to:

determine whether the second rotor spray bank should be activated based on the operating state;

estimate an aggregate amount of pressurized water that will be required to operate the first and second rotor spray banks when it is determined that the first and second rotor spray banks should be activated; and activate the second control valve by sending the second valve signal to the second control valve when it is determined that the second rotor spray bank should be activated.

3. The cold planer of claim 1, further comprising:

an intermediate stage conveyor mounted to the frame and extending from a drum transition region adjacent the drum, through an opening in the housing, and to a conveyor transition region, the intermediate stage conveyor configured to receive material planed by the drum and transport it to the conveyor transition region;

a transition region spray bank including a third plurality of spray nozzles disposed along a third spray manifold, within the housing, and being oriented towards the drum transition region;

a third control valve fluidly disposed between the main spray manifold and the third spray manifold, the third control valve selectively fluidly connecting the third spray manifold with the main spray manifold in response to a third valve signal;

wherein the electronic controller is further disposed to:

determine whether the transition region spray bank should be activated based on the operating state;

estimate an aggregate amount of pressurized water that will be required to additionally operate the transition region spray bank; and activate the third control valve by sending the third valve signal to the third control valve when it is determined that the transition region spray bank should be activated.

4. The cold planer of claim 3, further comprising:

an intermediate stage conveyor spray bank including a fourth plurality of spray nozzles disposed along a fourth spray manifold and being oriented towards material carried by the intermediate stage conveyor;

a fourth control valve fluidly disposed between the main spray manifold and the fourth spray manifold, the fourth control valve selectively fluidly connecting the fourth spray manifold with the main spray manifold in response to a fourth valve signal;

wherein the electronic controller is further disposed to:

determine whether the intermediate stage conveyor spray bank should be activated based on the operating state;

estimate an aggregate amount of pressurized water that will be required to additionally operate the intermediate stage conveyor spray bank; and activate the fourth control valve by sending the fourth valve signal to the fourth control valve when it is determined that the intermediate stage conveyor spray bank should be activated.

5. The cold planer of claim 3, further comprising:

a final stage conveyor mounted to the frame and extending from the conveyor transition region, the final stage conveyor configured to receive material from the intermediate stage conveyor;

a final stage conveyor spray bank including a fifth plurality of spray nozzles disposed along a fifth spray manifold and being oriented towards the material deposited onto the final stage conveyor;

a fifth control valve fluidly disposed between the main spray manifold and the fifth spray manifold, the fifth control valve selectively fluidly connecting the fifth spray manifold with the main spray manifold in response to a fifth valve signal;

wherein the electronic controller is further disposed to:

determine whether the final stage conveyor spray bank should be activated based on the operating state;

estimate an aggregate amount of pressurized water that will be required to additionally operate the final stage conveyor spray bank; and activate the fifth control valve by sending the fifth valve signal to the fifth control valve when it is determined that the final stage conveyor spray bank should be activated.

6. The cold planer of claim 1, further comprising:

a low pressure spray bank mounted to the frame and including one or more reeled hoses connected to respective manual spray nozzles;

a sixth control valve fluidly disposed between the main spray manifold and the one or more reeled hoses, the sixth control valve selectively fluidly connecting the one or more reeled hoses with the main spray manifold in response to a sixth valve signal;

wherein the electronic controller is further disposed to:

determine whether the low pressure spray bank should be activated based on the operating state;

estimate an aggregate amount of pressurized water that may be required to operate the low pressure spray bank when the one or more reeled hoses are flowing water at full capacity; and activate the sixth control valve by sending the sixth valve signal to the sixth control valve when it is determined that the low pressure spray bank should be activated.

7. The cold planer of claim 1, wherein the pump is a variable-speed pump that is operated by a hydraulic motor, the hydraulic motor being controlled by a metered flow of hydraulic fluid that is controlled by an electromechanical valve having an actuator that is responsive to the pump signal provided by the electronic controller.

8. A machine, comprising:

a frame;

a drum enclosed within a housing and arranged to rotate about a drum axis, the drum connected to the frame and configured to plane a road surface during operation;

a first spray bank mounted to the frame, the first spray bank including a first plurality of spray nozzles arranged along a first spray manifold, the first plurality of spray nozzles being oriented to wet the drum;

a water reservoir mounted on the frame;

a pump fluidly associated with the water reservoir and configured to draw water therefrom, the pump configured to pressurize the water to a variable pressure in response to a pump signal pressurize the water and provide pressurized water to a main spray manifold;

a pressure sensor associated with the main spray manifold and configured to provide a pressure signal indicative of a pressure of the pressurized water within the main spray manifold;

a first control valve fluidly disposed between the main spray manifold and the first spray manifold, the first control valve selectively fluidly connecting the main with the first spray manifold in response to a valve signal;

an electronic controller associated with the cold planer and configured to receive a plurality of operating signals indicative of an operating condition of the cold planer, the electronic controller disposed to:

monitor the plurality of operating signals;

determine an operating state of the cold planer based on the operating signals;

determine whether the first spray bank should be activated based on the operating state;

estimate an amount of pressurized water that will be required to operate the first spray bank when it is determined that the first spray bank should be activated;

determine a desired main spray manifold pressure based on the estimated amount of pressurized water;

determine a pump signal based on the desired main spray pressure, and send the pump signal to the pump;

activate the first control valve by sending the valve signal to the first control valve when it is determined that the first spray bank should be activated; and maintain the desired main spray manifold pressure by adjusting the pump signal based on the pressure signal as a primary control parameter.

9. The machine of claim 8, further comprising:

a second spray bank mounted to the frame and disposed in parallel with the first spray bank, the second spray bank including a second plurality of spray nozzles arranged along a second spray manifold, the second plurality of spray nozzles being oriented such that each of a second plurality of water sprays wets the drum;

a second control valve fluidly disposed between the main spray manifold and the second spray manifold, the second control valve selectively fluidly connecting the second spray manifold with the main spray manifold in response to a second valve signal;

wherein the electronic controller is further disposed to:

determine whether the second spray bank should be activated based on the operating state;

estimate an aggregate amount of pressurized water that will be required to operate the first and second spray banks when it is determined that the first and second spray banks are activated; and activate the second control valve by sending the second valve signal to the second control valve when it is determined that the second spray bank should be activated.

10. The machine of claim 8, further comprising:

an intermediate stage conveyor mounted to the frame and extending from a drum transition region to a conveyor transition region, the intermediate stage conveyor configured to transport material from the drum transition region to the conveyor transition region;

a transition region spray bank including a third plurality of spray nozzles disposed along a third spray manifold and being oriented towards the drum transition region;

a third control valve fluidly disposed between the main spray manifold and the third spray manifold, the third control valve selectively fluidly connecting the third spray manifold with the main spray manifold in response to a third valve signal;

wherein the electronic controller is further disposed to:

determine whether the transition region spray bank should be activated based on the operating state;

estimate an aggregate amount of pressurized water that will be required to additionally operate the transition region spray bank; and activate the third control valve by sending the third valve signal to the third control valve when it is determined that the transition region spray bank should be activated.

11. The machine of claim 10, further comprising:

an intermediate stage conveyor spray bank including a fourth plurality of spray nozzles disposed along a fourth spray manifold and being oriented towards material carried by the intermediate stage conveyor;

a fourth control valve fluidly disposed between the main spray manifold and the fourth spray manifold, the fourth control valve selectively fluidly connecting the fourth spray manifold with the main spray manifold in response to a fourth valve signal;

wherein the electronic controller is further disposed to:

determine whether the intermediate stage conveyor spray bank should be activated based on the operating state;

estimate an aggregate amount of pressurized water that will be required to additionally operate the intermediate stage conveyor spray bank; and activate the fourth control valve by sending the fourth valve signal to the fourth control valve when it is determined that the intermediate stage conveyor spray bank should be activated.

12. The machine of claim 10, further comprising:

a final stage conveyor mounted to the frame and extending from the conveyor transition region, the final stage conveyor configured to receive material from the intermediate stage conveyor;

a final stage conveyor spray bank including a fifth plurality of spray nozzles disposed along a fifth spray manifold and being oriented towards the material deposited onto the final stage conveyor;

a fifth control valve fluidly disposed between the main spray manifold and the fifth spray manifold, the fifth control valve selectively fluidly connecting the fifth spray manifold with the main spray manifold in response to a fifth valve signal;

wherein the electronic controller is further disposed to:

determine whether the final stage conveyor spray bank should be activated based on the operating state;

estimate an aggregate amount of pressurized water that will be required to additionally operate the final stage conveyor spray bank; and activate the fifth control valve by sending the fifth valve signal to the fifth control valve when it is determined that the final stage conveyor spray bank should be activated.

13. The machine of claim 8, further comprising:

a low pressure spray bank mounted to the frame and including one or more reeled hoses connected to respective manual spray nozzles;

a sixth control valve fluidly disposed between the main spray manifold and the one or more reeled hoses, the sixth control valve selectively fluidly connecting the one or more reeled hoses with the main spray manifold in response to a sixth valve signal;

wherein the electronic controller is further disposed to:

determine whether the low pressure spray bank should be activated based on the operating state;

estimate an aggregate amount of pressurized water that may be required to operate the low pressure spray bank when the one or more reeled hoses are flowing water at full capacity; and activate the sixth control valve by sending the sixth valve signal to the sixth control valve when it is determined that the low pressure spray bank should be activated.

14. The machine of claim 8, wherein the pump is a variable-speed pump that is operated by a hydraulic motor, the hydraulic motor being controlled by a metered flow of hydraulic fluid that is controlled by an electromechanical valve having an actuator that is responsive to the pump signal provided by the electronic controller.

15. A method for operating a cold planer, comprising:

generating, by a controller, at least one signal indicative of an operating state of the cold planer;

determining, by a controller, based on the at least one signal, an operating condition of the cold planer using a controller;

deciding, by a controller, on which spray banks from a plurality of spray banks should be activated based on the operating condition determination using an electronic controller;

estimating, by a controller, a water flow required to operate the spray banks that should be activated;

determining, by a controller, a pump command signal for a pump that provides the water flow using the controller;

commanding, by a controller, the pump to operate by sending the pump command signal from the controller to a pump-related actuator; and monitoring, by a controller, a water pressure in a main manifold and controlling the pump using a closed-loop control scheme that receives the water pressure as feedback to maintain a desired water pressure within the main manifold.

16. The method of claim 15, wherein the at least one signal including at least one of information on whether the cold planer is milling or travelling, a depth and speed of planing, the type of material being milled, a power draw of a milling drum, whether a material conveyor is operating, an operating speed of the material conveyor, an operating speed of the milling drum, a type of drum used, whether a vacuum for dust control is present and, if so, whether the vacuum is operational.

17. The method of claim 15, wherein determining an operating condition is accomplished by using a correlating function stored in the controller, the correlating function operating to determine a particular operating condition of the cold planer based on the at least one signal.

18. The method of claim 15, wherein deciding which spray banks should be activated is carried out in the controller using a lookup table that includes information correlating the operating state of each of the plurality of spray banks with the operating condition, the lookup table being stored in the controller.

19. The method of claim 15, wherein the controller determines the pump command signal using predetermined information water flow information that is correlated with the water flow required to operate each of the plurality of spray banks, and the controller automatically, and in real time, aggregates those water flows corresponding to the spray banks that should be activated.

20. The method of claim 15, further comprising changing the step of deciding on which spray banks to activate based on an operator input, which operator input overrides the controller decision in activating or deactivating specific spray banks.

* * * * *